US006684450B2

(12) United States Patent
Dingert

(10) Patent No.: US 6,684,450 B2
(45) Date of Patent: Feb. 3, 2004

(54) WRINGING DEVICE

(75) Inventor: Uwe Dingert, Abtsteinach (DE)

(73) Assignee: Carl Freudenberg KG, Weinheim (DE)

( * ) Notice: Subject to any disclaimer, the term of this patent is extended or adjusted under 35 U.S.C. 154(b) by 108 days.

(21) Appl. No.: 10/052,676

(22) Filed: Jan. 17, 2002

(65) Prior Publication Data

US 2002/0095739 A1 Jul. 25, 2002

(30) Foreign Application Priority Data

Jan. 18, 2001 (DE) ..... 101 02 078

(51) Int. Cl.[7] ..... A47L 13/14; A47L 13/58; B65D 25/00

(52) U.S. Cl. ..... 15/260; 15/261; 220/694

(58) Field of Search ..... 15/260, 261, 264; 222/461; 220/694, 908.3; 68/241, 242

(56) References Cited

U.S. PATENT DOCUMENTS 1,952,824 A * 3/1934 Schulman ..... 15/263
4,167,136 A * 9/1979 Chupurdy ..... 99/306
6,065,175 A * 5/2000 Tejerina ..... 15/116.1

FOREIGN PATENT DOCUMENTS

EP 0 489 237 6/1992

* cited by examiner

*Primary Examiner*—Robert J. Warden, Sr.
*Assistant Examiner*—Laura C Cole
(74) *Attorney, Agent, or Firm*—Kenyon & Kenyon

(57) ABSTRACT

A wringing device for cleaning elements of wet and damp mopping devices, including a liquid-permeable holder (1), which can be attached to a container (6) by a holder frame (5) and in which a cleaning element can be wrung out by pressing it in, the cleaning element being able to be brought towards the holder through an insertion funnel (2) which is separate from the holder and is fastenable in place on the holder frame.

20 Claims, 2 Drawing Sheets

WRINGING DEVICE

BACKGROUND OF THE INVENTION

1. Field of Invention

The invention relates to a wringing device for cleaning elements of wet and damp mopping devices, having a liquid-permeable holder which is attached to a container by a holder frame and in which a cleaning element can be wrung out by pressing it in.

2. Description of the Related Art

Such wringing devices are widely used for cleaning household floors. So-called cleaning mops are common, i.e. wet or damp mopping devices, where at one end of a handle, a cleaning element is provided, for example absorbent strips, strands, or fringes of a textile material that are bundled to form a mop head. To remove the moisture, the cleaning element must be wrung out or pressed out in a device. Wringing devices are common, where the mop head is introduced from the top, with the cleaning element hanging down vertically into a wringing space that is open towards the top. The liquid absorbed by the cleaning element is removed by pressing, squeezing, and/or wringing. The wringing space is permeable for liquid and the dirty water runs off into a container located below the wringing device. Wringing devices used in households can generally be attached to the edge of a cleaning bucket, and the mop is wrung out in a basket-like holder, by pressing it in.

Such a wringing device is known, for example, from EP 0 489 237. The holder is a funnel-shaped pressing basket having flexible wall parts, arranged at a distance from one another. These wall parts form arc-shaped spring shanks that are brought together on the holder frame at their one end, and in a bottom part at their other end. The holder frame is attached to the top edge of a cleaning bucket. To wring the mop out, it is introduced into the pressing basket from above. The mop is squeezed out by pressing it in. In the process, the liquid can only be removed from those strips that are located in the pressing basket. Mop strips that go between or outside the flexible wall parts when the mop is introduced, are not squeezed out. In particular, if the mop head is not mushroom-shaped, but rather, as is the case for a flat mop, for example, has the shape of an ellipsoid, the wringing result is unsatisfactory: The dirty water taken up during the preceding wiping process gets back onto the floor, at least in part. If one intends to prevent this and also press out textile strips located on the outside, it is necessary to precisely introduce the strips into the basket. Where necessary, the mop must be pressed into the pressing basket several times. This requires skill and patience and makes efficient floor cleaning more difficult.

SUMMARY OF THE INVENTION

It is an object of the invention to provide a wringing device for a mop wherein the cleaning element may be introduced and wrung out more efficiently. It is a further object of the invention to provide such a wringing device which is cost-effective.

These and other objects of the invention are achieved by a wringing device for cleaning elements of wet and damp mopping devices, having a liquid-permeable holder (1) which is attachable to a container (6) by a holder frame (5) and in which a cleaning element can be wrung out by pressing it in, wherein the cleaning element is guidable towards the holder through an insertion funnel (2) which is separate from the holder and is able to be fastened in place on the holder frame.

BRIEF DESCRIPTION OF THE DRAWINGS

The present invention will be described in greater detail with reference to the following drawings wherein.

DETAILED DESCRIPTION OF THE INVENTION

Figure 1:
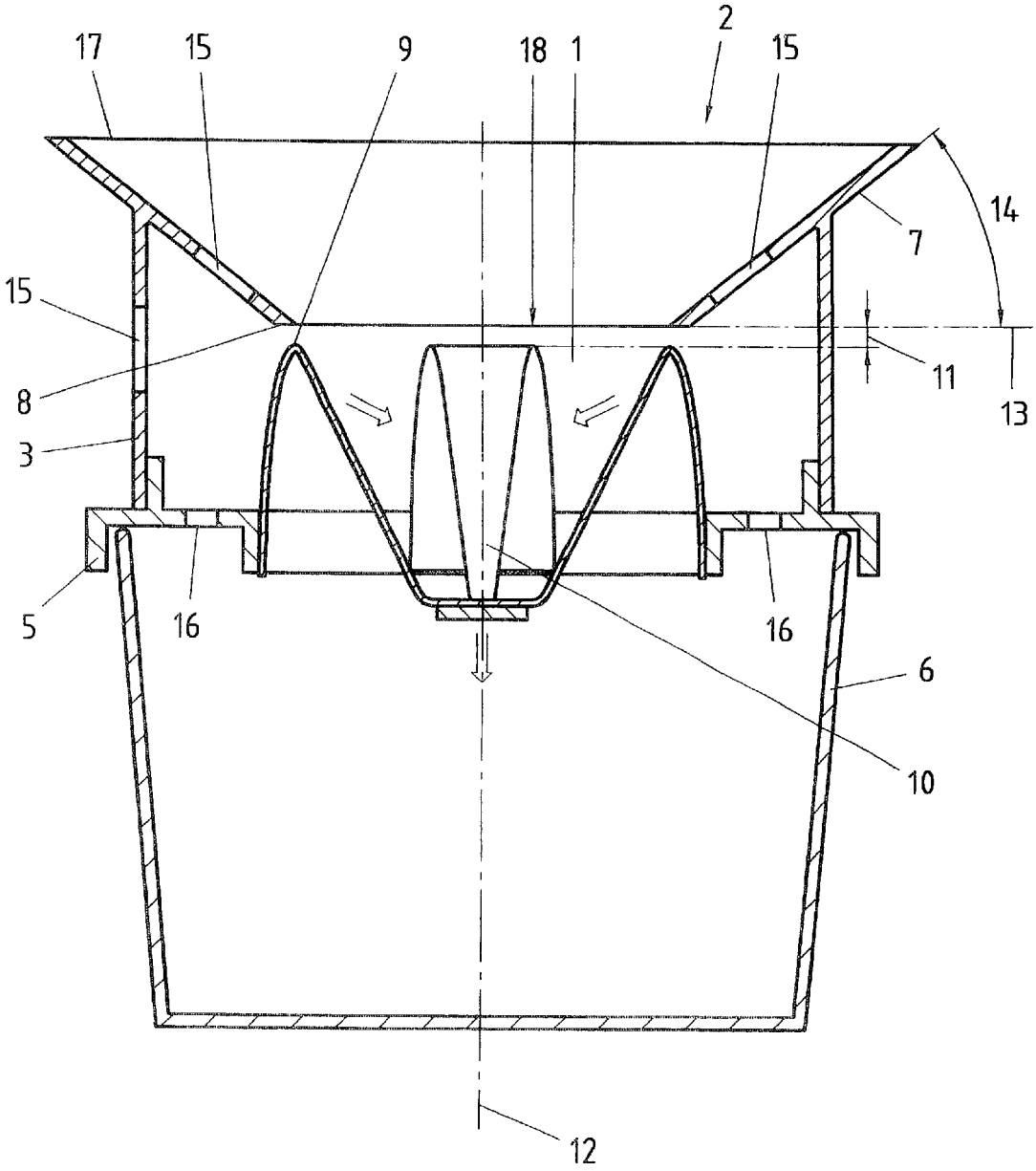
FIG. 1 shows a first preferred exemplary embodiment of the wringing device according to the present invention, in cross-section.

The cleaning element is able to be brought towards the holder through an insertion funnel which is separate from the holder and is securely attachable to the holder frame. In this way, separate parts are provided for inserting and for pressing out the mop. The separate parts make it possible to provide a large diameter for insertion and a small diameter for the wringing procedure in the pressing basket. Because of the separation of tasks, the design of the wringing basket and that of the insertion aid are uncoupled from one another.

The insertion funnel, which comes first, forms a centering device for the fringes or strips of the mop that hang down. The solid, frustoconical surface of the insertion funnel guides the mop bundle completely into the wringing basket. Because of the bundling, hardly any cleaning elements remain outside the wringing basket. In response to the pressing-in action, all of the liquid absorbed during the prior wiping process is removed from the textile strips. Absorbed dirty water no longer gets back onto the floor. When the insertion funnel is used as an auxiliary device for a first step, insertion and consequently wringing of the cleaning element succeeds better. Cleaning the floor is faster and more efficient.

The holder and the insertion funnel may be produced in a cost-effective manner as separate components. When provided with a suitable form design, they may be stacked with a high packing density, thereby reducing transport and storage costs.

There are a number of ways available to one skilled in the art to fasten the insertion funnel to the holder frame. The insertion funnel may be fastened in place on the holder frame by a clamping device, for example, or by a snap-in lock.

It is advantageous if the insertion funnel has a cone-like mantle part and a support frame molded onto it, where the latter may be rigidly connected with the holder frame. In this way, the holder and the insertion funnel may be produced as separate components, and stored and transported at low expense. The components are not rigidly connected with one another until just before delivery to the customer. They are, therefore, permanently joined together during use.

With regard to the production costs, it is very advantageous if the cone-like mantle part and the support frame are produced in one piece and made of a polymer material. The connection between the holder and the insertion funnel is preferably a permanent plug-in or snap-in connection, or may be a bonded or glued connection.

The wringing device represents a mass-produced article for household use. It is advantageous if the mantle part and/or the support frame has perforations, and that material and weight are saved in this way. These perforations are dimensioned, in terms of their shape and size, in such a way that the fringes or strips are not able to get tangled in them. The geometric shape of the perforations in the mantle part and the support frame may be advantageously coordinated with the shape of the mop being used. In this manner, the aesthetic shape of the mop is reflected in the wringing device, something that may be attractive to the user.

A cone-like mantle part that encloses an angle between 15° and 70° with a horizontal plane is preferred. In this way, very good insertion and a good flow of dirty water dripping into the wringing basket are achieved.

A very good bundling effect may be achieved by the cone-like mantle part, in particular, if a bottom edge encloses a bottom pass-through surface that is structured to be congruent to or smaller than a top edge of the holder. Because of these pass-through surfaces, which at least cover each other, the fringes of the cleaning element do not get tangled between the pressing basket and the insertion funnel. After an extended period of use, the top edge of the holder can become narrower, because of plastic deformation of the individual spring shanks. As long as the bottom pass-through surface is smaller than the area circumscribed by the top edge of the holder, the centering effect of the funnel is maintained.

In terms of the aspect of low production costs, it has proven to be advantageous if the cone-like mantle part and the support frame are structured with rotation symmetry around an axis, and if the diameter of the top edge of the mantle part is 1.2 to 2 times larger than the diameter of the bottom pass-through surface.

Using injection-molding technology, the wringing device may be made from plastic, at low cost. Efficient floor cleaning is assured, in particular, if the holder is structured with flexible, moldable wall parts that increase or decrease their clearance when the cleaning element is pressed in.

FIG. 1 shows a cross-sectional view of a first exemplary embodiment of the wringing device according to the present invention, where holder 1 is designed as a wringing basket and fixed in place on a bucket 6 located beneath it, by a holder frame 5. An insertion funnel 2 is disposed upstream of holder 1, and is fixed in place on holder frame 5 by a support frame 3. The drawing in FIG. 1 preferably shows the connection between insertion funnel and holder frame as a clamped or glued connection between a projection on holder frame 5 and on support frame 3. However, the connection may also be formed by a bonding connection, or by a permanent snap-in connection. Also, a one-piece design is possible. A funnel cone-like mantle part 7 is easy to recognize; it precedes holder 1 at a distance 11 from the top of spring elements 10. During floor cleaning, a cleaning mop, not shown in any detail in FIG. 1, is introduced into the wringing device from above, with its strands or fringes hanging vertically down. In this connection, the cleaning element passes through the pass-through surface enclosed by top edge 17, and at first experiences a centering effect in the direction of holder 1, caused by cone-shaped mantle part 7. Because of the pressing force that is directed downwards in this first embodiment, during the further course of the process, the top points of spring elements 10 are displaced in the direction of axis of symmetry 12, at top edge 9 of holder 1. Spring elements 10 press against the strips of the cleaning element. In FIG. 1, this pressing effect is indicated schematically with arrows, one pointing down and two pointing in the direction of axis of symmetry 12, pointing to the inside of the wringing basket. The dirty water that is squeezed out during the pressing process flows between spring elements 10, into bucket 6. Cone-like mantle part 7 has perforations 15, but with a size and shape selected in such a way that the strands or fringes of the cleaning mop are reliably guided into the center of the wringing container and do not get tangled. Dirty water that drips off is guided into bucket 6 through holes 16 in holder frame 5. As is readily evident in FIG. 1, bottom pass-through surface 18 defined by bottom edge 8 is congruent to the entry surface of the wringing basket, which is circumscribed by the peak points of spring elements 10 at top edge 9. Mantle part 7 encloses an angle 14, with the horizontal 13, that is preferably between 15 and 70°. Of course, mantle part 7 in the shape of a truncated cone may also be coordinated with the shape of the cleaning mop, i.e. it may be circular, oval, rectangular, square, or have the shape of an n-sided polygon. It is also possible that the mantle surface of mantle part 7 is curved in convex or concave shape relative to axis 12.

Figure 2:
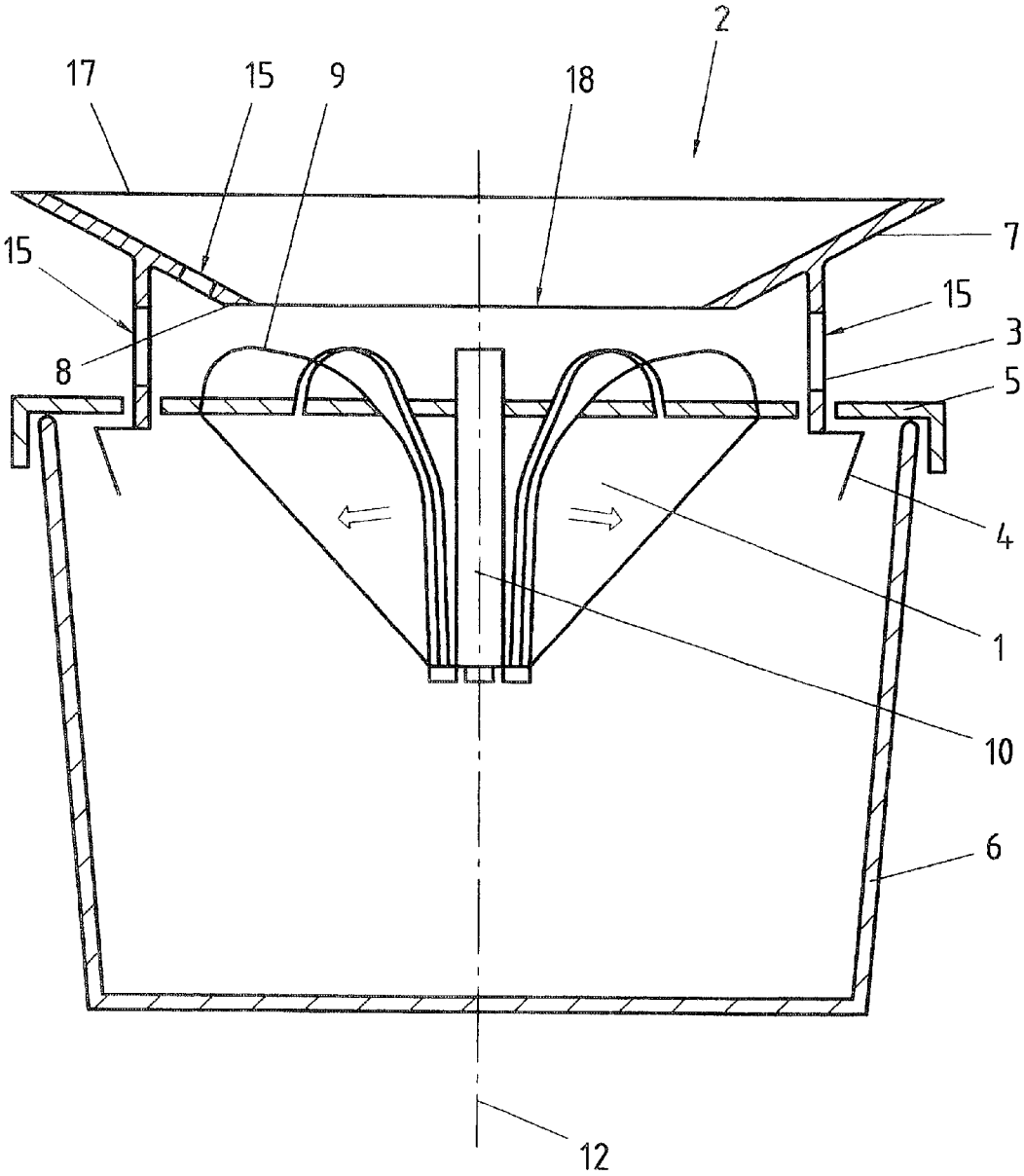
FIG. 2 shows a second preferred exemplary embodiment of the wringing device according to the present invention, in cross-section.

In the representation of FIG. 2, a second preferred exemplary embodiment of the wringing device according to the present invention is shown in cross-section. Here again, the mop is introduced into the wringing device from above, and passes through pass-through surfaces 17 and 18, the frusto-conical base surfaces of insertion funnel 2. In contrast to the embodiment shown in FIG. 1, in this design, wringing the cleaning element out is achieved by increasing the clearance of spring elements 10 of holder 1. As is indicated in FIG. 2 by two arrows pointing away from axis of symmetry 12, the pressing movement directed downwards causes a lateral deflection of spring elements 10 of holder 1, which are shaped like a tulip flower. Here again, the dirty water that is pressed out is collected in a cleaning bucket 6 located underneath, where a holder frame 5 is attached to its upper edge, for example by holder claws, not shown. According to the present invention, insertion funnel 2 is at a distance from peak 9 of holder 1. Preferably, insertion funnel 2 and holder frame 5 are separate parts. In FIG. 2, a snap-in connection 4 is shown, which fixes support frame 3 in place on holder frame 5. This forms a rigid connection between insertion funnel 2 and holder 1. The snap-in connection may be structured to be releasable or non-releasable. With regard to costs, it is advantageous that both components may be produced separately, in simple dies, and may be easily stacked during delivery and interim storage. This keeps the transport and storage costs low. Insertion funnel 2 is not mounted on holder frame 5 until just before delivery to the customer. A non-releasable snap-in connection has the advantage that the insertion funnel is permanently attached to the holder. Of course, a plug-in connection, where a permanent positive lock is achieved by thermal action, may also be used in place of the non-releasable snap-in connection.

To economize on material and reduce weight, perforations 15 are preferably provided on cone-shaped mantle part 7 and/or on support frame 3. Preferably, perforations 15 show a company logo or product symbol, or reflect the shape of the mop.

Here again, cone-like mantle part 7 of insertion funnel 2 is by no means limited to the rotation-symmetrical mantle surface of the cone. For example, as mentioned above, top edge 17 and/or bottom edge 8 may be formed by a polygon shape, and/or the mantle surface for introduction of the mop may have a convex or concave curvature. As described for the embodiment of FIG. 1, peak 9 formed by the peaks of spring elements 10 is at a distance from bottom edge 8 of cone-shaped mantle part 7, whereby the tasks of pressing out the mop and easier introduction of the cleaning element are uncoupled from one another in the design of the device, according to the present invention.

The present invention is by no means limited to holders with elastic wall elements in the pressing space, but rather also covers holders with a pressing space formed by a perforated cone, for example. Here again, the perforated cone may be dimensionally sized for efficient wringing, on the one hand, and the insertion funnel may be dimensioned for an optimum guidance effect, on the other hand, separately from one another, in accordance with the present invention.

What is claimed is:

1. A wringing device for cleaning elements of wet and damp mopping devices, comprising: a liquid-permeable holder (1) which is attachable to a container (6) by a holder frame (5) and in which a cleaning element can be wrung out by pressing it in, said holder (1) including an insertion funnel (2) configured such that the cleaning element is guidable towards the holder through the insertion funnel (2) which is separate from the holder and is removably fastenable in place on the holder frame.

2. The device according to claim 1, wherein the insertion funnel (2) includes a cone-like mantle part (7) and an integrally formed support frame (3) that is rigidly connected with the holder frame (5).

3. The device according to claim 2, wherein the cone-like mantle part (7) and the support frame (3) are made in one piece, of a polymer material.

4. The device according to claim 3, wherein a lower edge (8) of the cone-like mantle part (7) encloses a bottom pass-through surface (18) which is designed to be congruent to or smaller with respect to a top edge (9) of the holder (1).

5. The device according to claim 4, wherein the cone-like mantle part (7) and the support frame (3) are designed to be rotationally symmetric around an axis (12), and the diameter of the top edge (17) of the mantle part (7) is 1.2 to 2 times larger than the diameter of the bottom pass-through surface (18).

6. The device according to claim 2, wherein a lower edge (8) of the cone-like mantle part (7) encloses a bottom pass-through surface (18) which is designed to be congruent to or smaller with respect to a top edge (9) of the holder (1).

7. The device according to claim 6, wherein the cone-like mantle part (7) and the support frame (3) are designed to be rotationally symmetric around an axis (12), and the diameter of the top edge (17) of the mantle part (7) is 1.2 to 2 times larger than the diameter of the bottom pass-through surface (18).

8. A wringing device for cleaning elements of wet and damp mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the insertion funnel (2) includes a cone-like mantle part (7) and an integrally formed support frame (3) that is rigidly connected with the holder frame (5), wherein the cone-like mantle part (7) and the support frame (3) are made in one piece, of a polymer material, and wherein the cone-like mantle part (7) or the support frame (3) have perforations (15).

9. The device according to claim 8, wherein the cone-like mantle part (7) encloses an angle (14) between 15° and 70° with a horizontal plane (13).

10. The device according to claim 8, wherein a lower edge (8) of the cone-like mantle part (7) encloses a bottom pass-through surface (18) which is designed to be congruent to or smaller with respect to a top edge (9) of the holder (1).

11. The device according to claim 10, wherein the cone-like mantle part (7) and the support frame (3) are designed to be rotationally symmetric around an axis (12), and the diameter of the top edge (17) of the mantle part (7) is 1.2 to 2 times larger than the diameter of the bottom pass-through surface (18).

12. A wringing device for cleaning elements of wet and damn mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the insertion funnel (2) includes a cone-like mantle part (7) and an integrally formed support frame (3) that is rigidly connected with the holder frame (5), and wherein the cone-like mantle part (7) encloses an angle (14) between 15° and 70° with a horizontal plane (13).

13. The device according to claim 12, wherein a lower edge (8) of the cone-like mantle part (7) encloses a bottom pass-through surface (18) which is designed to be congruent to or smaller with respect to a top edge (9) of the holder (1).

14. The device according to claim 13, wherein the cone-like mantle part (7) and the support frame (3) are designed to be rotationally symmetric around an axis (12), and the diameter of the top edge (17) of the mantle part (7) is 1.2 to 2 times larger than the diameter of the bottom pass-through surface (18).

15. A wringing device for cleaning elements of wet and damp mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the insertion funnel (2) includes a cone-like mantle part (7) and an integrally formed support frame (3) that is rigidly connected with the holder frame (5)

wherein the cone-like mantle part (7) and the support frame (3) are made in one piece, of a polymer material, and wherein the cone-like mantle part (7) encloses an angle (14) between 15° and 7° with a horizontal plane (13).

16. A wringing device for cleaning elements of wet and damp mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the holder (1) has moldable wall parts (10) and one of reduces and increases its inside clearance when the cleaning element is pressed in.

17. The device according to claim 16, wherein the wall parts (10) are designed as spring elements having a convex curvature.

18. A wringing device for cleaning elements of wet and damp mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the insertion funnel (2) includes a cone-like mantle part (7) and an integrally formed support frame (3) that is rigidly connected with the holder frame (5), and wherein the holder (1) has moldable wall parts (10) and one of reduces and increases its inside clearance when the cleaning element is pressed in.

19. The device according to claim 18, wherein the wall parts (10) are designed as spring elements having a convex curvature.

20. A wringing device for cleaning elements of wet and damp mopping devices, comprising: a liquid-permeable holder (1) which is attachable to a container (6) by a holder frame (5) and in which a cleaning element can be wrung out by pressing it in, said holder including an insertion funnel (2) configured such that the cleaning element is guidable towards the holder through the insertion funnel (2) which is separate from the holder and is able to be fastened in place on the holder frame, wherein the insertion funnel (2) includes a cone-like mantle part (7) and an integrally formed support frame (3) that is rigidly connected with the holder frame (5), wherein the cone-like mantle part (7) and the support frame (3) are made in one piece, of a polymer material, and wherein the holder (1) has moldable wall parts (10) and one of reduces increases its inside clearance when the cleaning element is pressed in.

* * * * *

UNITED STATES PATENT AND TRADEMARK OFFICE

CERTIFICATE OF CORRECTION

PATENT NO. : 6,684,450 B2
APPLICATION NO. : 10/052676
DATED : February 3, 2004
INVENTOR(S) : Uwe Dingert It is certified that error appears in the above-identified patent and that said Letters Patent is hereby corrected as shown below:

Column 6, line 50, Claim 15, change “between 15° and 7°” to --between 15° and 70°--.

Signed and Sealed this

Tenth Day of July, 2007

JON W. DUDAS
*Director of the United States Patent and Trademark Office*